US007217165B2

(12) United States Patent
Roos

(10) Patent No.: US 7,217,165 B2
(45) Date of Patent: May 15, 2007

(54) WATERJET STEERING AND REVERSING APPARATUS

(75) Inventor: Paul W. Roos, Delray Beach, FL (US)

(73) Assignee: Apex Hydro Jet, LLC, Delray Beach, FL (US)

( * ) Notice: Subject to any disclaimer, the term of this patent is extended or adjusted under 35 U.S.C. 154(b) by 191 days.

(21) Appl. No.: 10/947,957

(22) Filed: Sep. 23, 2004

(65) Prior Publication Data

US 2005/0064771 A1 Mar. 24, 2005

Related U.S. Application Data

(60) Provisional application No. 60/505,065, filed on Sep. 23, 2003.

(51) Int. Cl.
*B63H 11/11* (2006.01)
*B63H 11/01* (2006.01)

(52) U.S. Cl. ..... 440/41; 440/46

(58) Field of Classification Search ..... 440/38, 440/40, 41, 42, 43
See application file for complete search history.

(56) References Cited

U.S. PATENT DOCUMENTS 3,422,788 A * 1/1969 Horan, Jr. ..... 440/41
4,212,442 A 7/1980 Fage
4,509,923 A 4/1985 Turnbull
4,992,065 A 2/1991 Torneman et al.
5,304,078 A 4/1994 Kaneko
5,421,753 A 6/1995 Roos
6,152,792 A 11/2000 Lanni et al.
6,227,919 B1 * 5/2001 Blanchard ..... 440/42
6,652,332 B1 * 11/2003 Westhoff ..... 440/41
2003/0054707 A1 * 3/2003 Morvillo ..... 440/40

* cited by examiner

*Primary Examiner*—Jesús D. Sotelo
(74) *Attorney, Agent, or Firm*—Jansson Shupe & Munger Ltd.

(57) ABSTRACT

Steering and reversing apparatus for a waterjet-powered marine vessel, the waterjet having an intake duct, a diffuser, and a steering nozzle and producing a rearward water stream flowing from the steering nozzle, the apparatus comprising: a nozzle pivot pivotably attaching the nozzle to the diffuser about a substantially vertical axis perpendicular to the water stream; at least one reversing duct affixed to and positioned substantially below the nozzle and having an opening to the nozzle; a reverse deflector pivotably attached to the diffuser about a horizontal axis substantially perpendicular to the water stream and having a sealing portion; and a nozzle sealing face having an exit shape mating with the sealing portion of the reverse deflector at any angular position of the steering nozzle, whereby, when the reverse deflector is pivoted such that the sealing portion mates with the nozzle sealing face, the water stream is deflected forward and underneath the vessel through the opening to the nozzle, steerably reversing the vessel.

5 Claims, 4 Drawing Sheets

FORWARD STARBOARD TURN

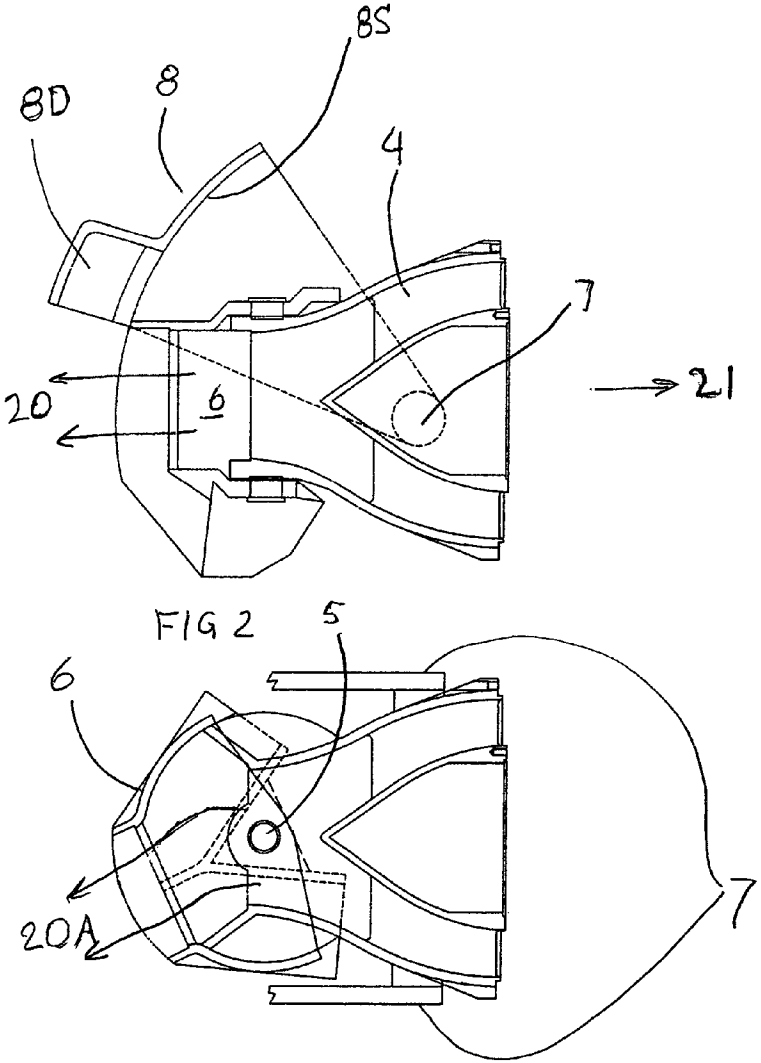
FIGURE 3 FORWARD STARBOARD TURN

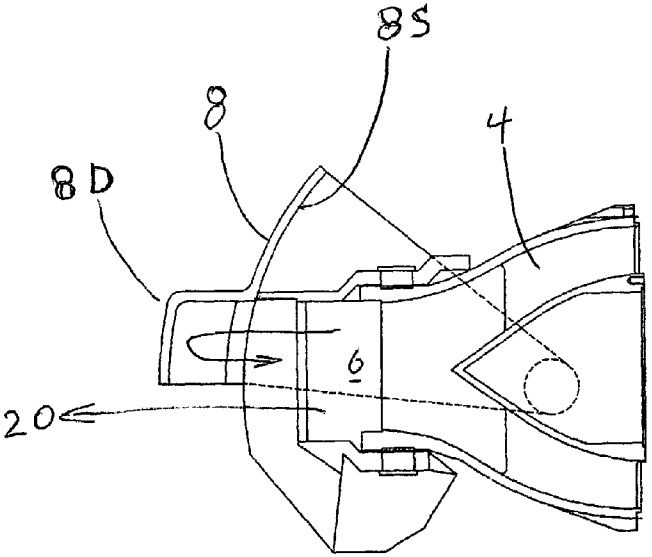
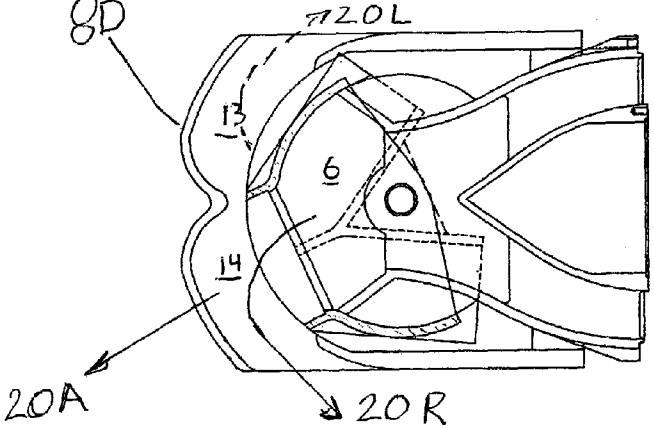
FIGURE 5 ZERO SPEED STARBOARD TURN

FIGURE 7 REVERSE STARBOARD TURN

WATERJET STEERING AND REVERSING APPARATUS

RELATED APPLICATION

This application is based on U.S. Provisional Application No. 60/505,065 filed on Sep. 23, 2003.

FIELD OF THE INVENTION

This invention relates to the field of marine propulsion, and more particularly to the improvement of the steering and reversing control of waterjet-propelled marine vessels.

BACKGROUND OF THE INVENTION

Waterjet propulsion has many benefits over propeller propulsion of marine vessels. The main benefit is one of safety, having no protrusions below the hull. Another benefit is the better maneuverability of the vessel because waterjets have the capability to direct the jet thrust in any direction. Steering and reversing is effected by deflecting the jet stream to either side through the use of deflecting baffles or by turning an articulating nozzle left or right. In both cases, the flow direction of the jet stream results in vessel directional change. Such baffles or articulating nozzles pivot about a vertical axis, and the pivots are supported by a diffuser, fixed to the pump, that ducts the jet flow from the pump to the nozzle.

Reverse operation of the vessel is obtained by re-directing the jet stream generally forward and underneath the vessel by the use of a reverse gate that pivots about a horizontal axis and deflects the jet flow. In one approach to provide reverse thrust and steering, made popular by C.W.F Hamilton and Company of New Zealand, the pivots of the reverse gate (also referred to as a reverse bucket) are supported by the diffuser. The reverse gate stops the rearward direction of the jet stream and through ducts provided in the reverse gate, sending the water forward and underneath the vessel, thereby causing the vessel to move in reverse. The steering deflector or steering nozzle is placed in such a way, that, while in reverse, the response will be opposite to that of a rudder steered vessel, causing confusion for the experienced mariner. Neutral is obtained by dropping the reverse gate half way down so that the upper portion of the water stream is reversed and the lower portion remains untouched, balancing forward and reverse flows. Turning the steering wheel in either direction causes the vessel to rotate in place since the resultant effect of the balanced forces is a sideways force on the stern. This is referred to as zero-speed steering and is considered a desirable feature, enhancing maneuverability of waterjet-powered vessels.

A second approach for steering and reversing waterjet-powered vessels can be seen in U.S. Pat. No. 5,304,078 (Kaneko) entitled "REVERSE THRUST BUCKET FOR JET DEVICE." In this approach, the reverse gate pivots are attached to the steering nozzle, and the nozzle is provided with a reverse water flow outlet underneath the nozzle, so that when the jet stream is cut by the dropping reverse gate, the water is re-directed through this outlet and expelled below the vessel and forward, creating a reverse response. Articulating the steering nozzle will produce steering response in the conventional way identical to rudder steered vessels. In this method however, no steering response in neutral is obtained since forward and reverse water flows balance no matter what steering direction is selected. Another disadvantage of the second reverse method is that the reversing system deflects the reverse water flow directly into the waterjet intake, aerating the waterjet pump and rendering the waterjet and the steering and reverse response less effective.

The instant invention combines the advantages of the zero-speed steering of the first approach with the advantages of conventional reverse response of the second approach while avoiding the disadvantages of both approaches.

OBJECTS OF THE INVENTION

It is an object of this invention to provide a waterjet steering and reversing mechanism with directional performance similar to propeller and rudder marine systems.

It is another object of this invention to provide zero-speed steering for waterjet-powered vessels while also providing reverse steering in the traditional manner.

Yet another object of this invention is to provide a steering and reversing mechanism for waterjet-powered vessels that minimizes aeration of the reverse-flow entering the waterjet intake.

These and other objects of the invention will be apparent from the following descriptions and from the drawings.

SUMMARY OF THE INVENTION

The invention is steering and reversing apparatus for a waterjet-powered marine vessel. The waterjet has an intake duct, a diffuser, and a steering nozzle and produces a rearward water stream flowing from the steering nozzle. The inventive apparatus comprises: a nozzle pivot pivotably attaching the nozzle to the diffuser about a substantially vertical axis perpendicular to the water stream; at least one reversing duct affixed to and positioned substantially below the nozzle and having an opening to the nozzle; a reverse deflector pivotably attached to the diffuser about a horizontal axis substantially perpendicular to the water stream and having a sealing portion; and a nozzle sealing face having an exit shape mating with the sealing portion of the reverse deflector at any angular position of the steering nozzle. When the reverse deflector is pivoted such that the sealing portion mates with the nozzle sealing face, the water stream is deflected forward and underneath the vessel through the opening to the nozzle, steerably reversing the vessel.

In a highly preferred embodiment of the invention, the reverse deflector further includes a deflecting portion shaped to turn and divide the water stream into two reverse flow streams aimed in forward and outwardly opposite directions. When the reverse deflector is pivoted such that the deflecting portion engages the water stream, vessel steering is obtained as pivoting of the steering nozzle apportions water between the two reverse flow water streams.

In another highly preferred embodiment of the invention, the at least one reversing duct is a split duct.

BRIEF DESCRIPTION OF THE DRAWINGS

FIG. 2 is a cross-sectional elevation of the diffuser, the steering nozzle, and reverse deflector, with the reverse deflector in forward mode.

FIG. 3 is a cross-sectional plan view of the diffuser, the steering nozzle, and reverse deflector, with the reverse deflector in forward mode and the steering nozzle in a starboard turn.

FIG. 4 is a cross-sectional elevation of the diffuser, the steering nozzle, and reverse deflector, with the reverse deflector in zero-speed mode.

FIG. 5 is a cross-sectional plan view of the diffuser, the steering nozzle, and reverse deflector, with the reverse deflector in zero-speed mode and the steering nozzle in a starboard turn.

FIG. 7 is a cross-sectional plan view of the diffuser, the steering nozzle, and reverse deflector, with the reverse deflector in reverse and the steering nozzle in starboard reverse turn.

DETAILED DESCRIPTION OF PREFERRED EMBODIMENTS

Figure 1:
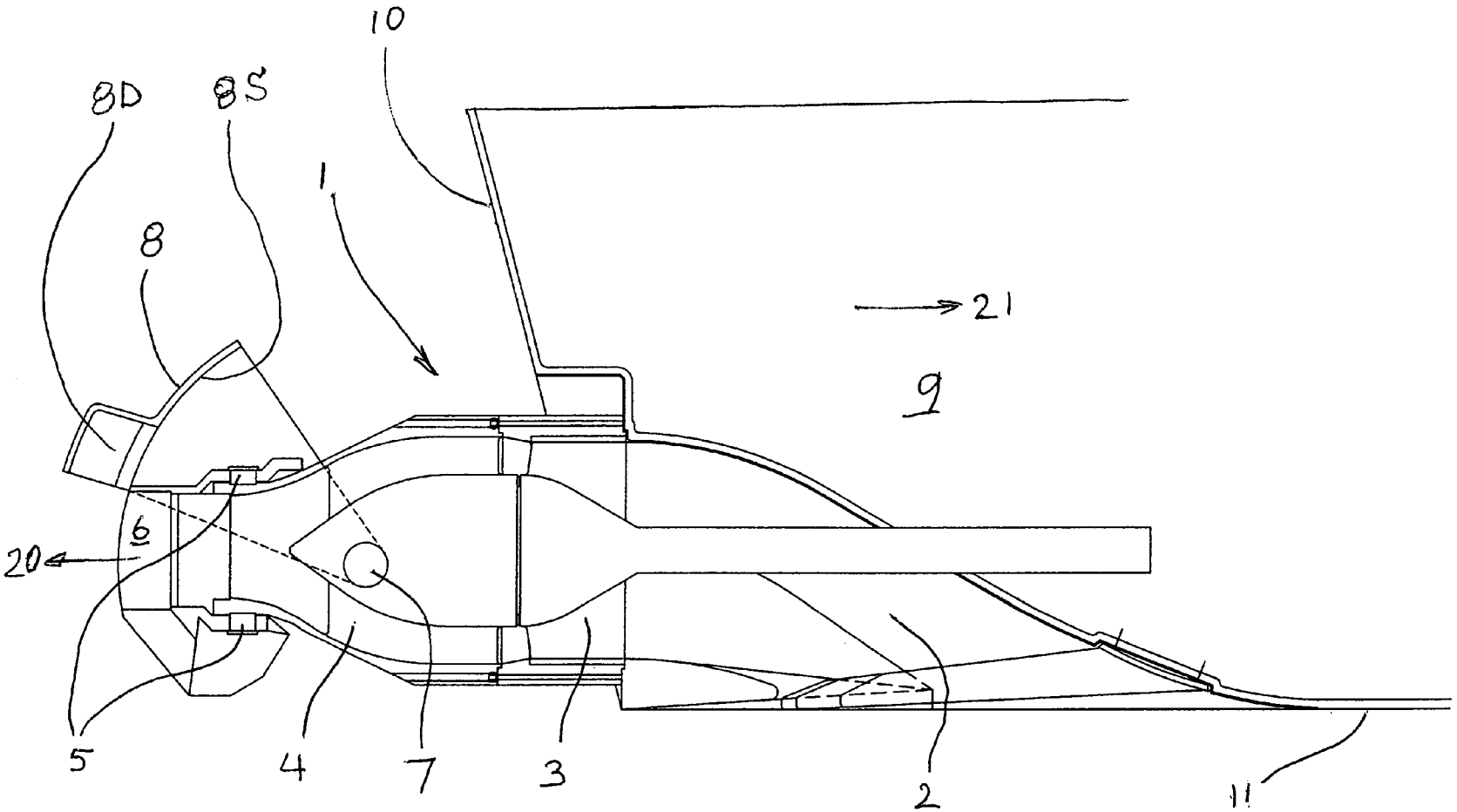
FIG. 1 is an elevation section with the invention steering and reversing apparatus.

FIG. 1 shows a waterjet 1 installed in a vessel 9 having a transom 10 and a bottom 11 with an intake duct 2, an impeller 3, and a diffuser 4 that supports the upper and lower pivots 5 of a steering nozzle 6 and pivots 7 of a reverse deflector 8. Appropriate control linkages, well-known in the art of marine controls, operate steering nozzle 6 and reverse gate 8. Steering nozzle 6 pivots around the vertical axis of pivots 5 to change the direction of a water stream 20 in order to steer vessel 9.

Reverse deflector 8 has a sealing portion 8S and a deflecting portion 8D and pivots around the horizontal axis of pivots 7 in order to position either deflecting portion 8D or sealing portion 8S into water stream 20, thereby deflecting all or a portion of water stream 20. FIGS. 2 through 7 are used to illustrate the various combinations of reverse deflector and steering nozzle positions which yield various vessel directions of movement.

FIG. 2 shows reverse deflector 8 in a raised position with waterjet 1 propelling vessel 9 in a forward vessel direction 21. FIG. 3 shows steering nozzle 6 in a starboard/forward turn position, directing the flow of a water stream 20A to the right, resulting in a vessel starboard/forward turn. (Water stream 20 is given different reference numbers to indicate the different directions of flow.)

FIGS. 4 and 5 show reverse deflector 8 in a zero-speed or neutral position. The geometry of deflecting portion 8D of reverse deflector 8 is shown in FIG. 5, including split deflector halves 13 and 14 of deflecting portion 8D. The shape of deflecting portion 8D is such that when lowered into water stream 20, at least a portion of water stream 20 is divided into two reverse flow streams 20L and 20R, aimed in forward and outwardly opposite directions.

As steering nozzle 6 is pivoted, the amount of water apportioned between two reverse flow streams 20L and 20R cause vessel 9 to rotate in the direction following the rotation of the steering wheel. When only a portion of water stream 20 is divided by deflecting portion 8D of reverse deflector 8, a remaining portion 20A of water stream 20 still provides some forward thrust to vessel 9. When the forward and reverse portions of the thrust balance each other, vessel 9 is only rotates, moving neither forward or backward. Forward and backward thrust is apportioned by the amount that reverse deflector 8 is pivoted into water stream 20. FIG. 5 shows steering nozzle 6 in starboard turn position.

Figure 6:
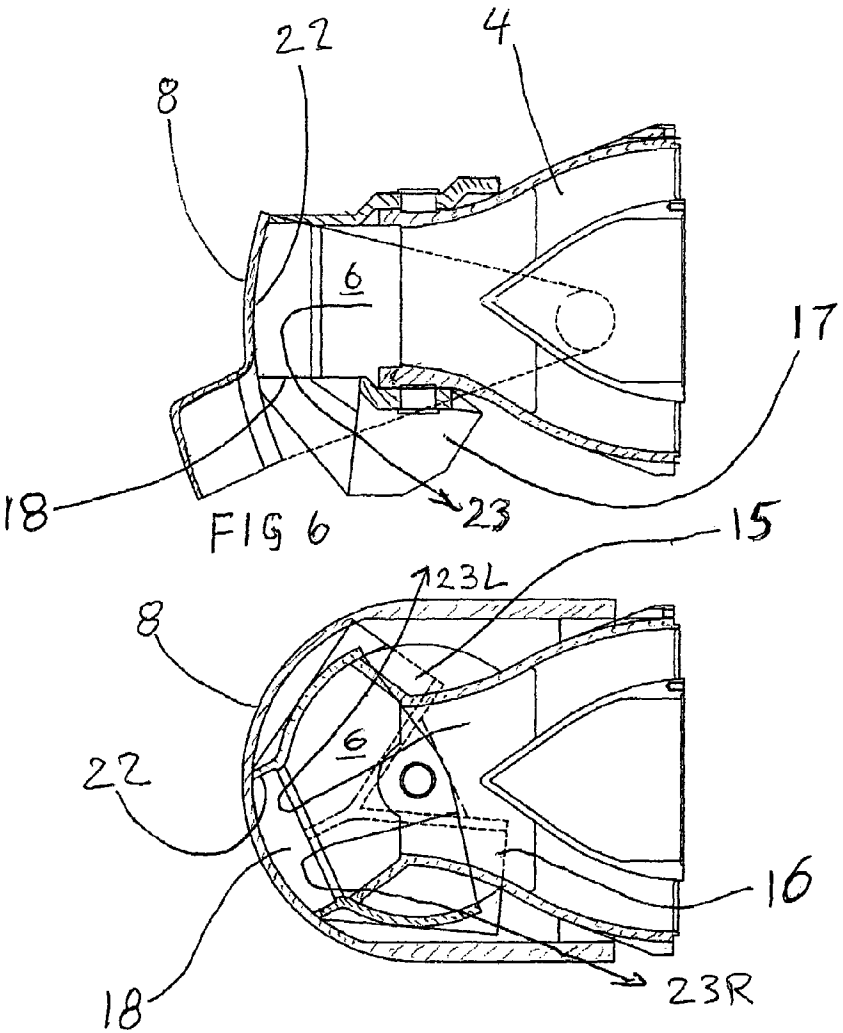
FIG. 6 is a cross-sectional elevation of the diffuser, the steering nozzle, and reverse deflector, with the reverse deflector in the reverse position.

FIGS. 6 and 7 show reverse deflector 8 in a reverse position and steering nozzle 6 in a starboard turn position. The reverse position of reverse deflector 8 is obtained when sealing portion 8S of reverse deflector 8 mates with a nozzle sealing face 22 of steering nozzle 6. When reverse deflector 8 is fully in the reverse position, all of the water in water stream 20 is deflected into a water stream 23 directed in a forward direction. Split duct 17 has an opening 18 which permits water to flow from water stream 20 into water stream 23. Water stream 23 is split into two reverse flow water streams 23L and 23R by two arms of a split duct 17 (reversing duct) having two ports 15 and 16, producing streams 23L and 23R, respectively. Thus, in the reverse position, the vessel has normal reverse steering response.

While the principles of this invention have been described in connection with specific embodiments, it should be understood clearly that these descriptions are made only by way of example and are not intended to limit the scope of the invention.

The invention claimed is:

1. Steering and reversing apparatus for a waterjet-powered marine vessel, the waterjet having an intake duct, a diffuser, and a steering nozzle and producing a water stream flowing from the steering nozzle, the apparatus comprising:

a nozzle pivot pivotably attaching the nozzle to the diffuser about a substantially vertical axis perpendicular to the water stream;

at least one reversing duct affixed to and positioned substantially below the nozzle and having an opening to the nozzle;

a reverse deflector pivotably attached to the diffuser about a horizontal axis that is on the diffuser and substantially perpendicular to the water stream, the deflector having a sealing portion and being movable to varying positions between a fully-open forward-thrust position and a fully-closed rearward-thrust position; and a sealing face formed on the nozzle, the face mating with the sealing portion of the reverse deflector to provide sealing engagement of the reverse deflector and the nozzle at any angular position of the nozzle, whereby, when there is sealing engagement, the water stream is deflected forward and underneath the vessel through the opening to the nozzle, steerably reversing the vessel.

2. The steering and reversing apparatus of claim 1 wherein the reverse deflector further includes a lower deflecting portion below the sealing portion shaped to turn and divide the water stream into two reverse flow streams aimed in outwardly opposite forward directions, whereby, when the reverse deflector is pivoted such that the deflecting portion engages the water stream, vessel steering is obtained as pivoting of the steering nozzle apportions water between the two reverse flow water streams.

3. The steering and reversing apparatus of claim 1 wherein the at least one reversing duct is a split duct.

4. The steering and reversing apparatus of claim 1 wherein the at least one reversing duct and the nozzle are a one-piece structure.

5. The steering and reversing apparatus of claim 4 wherein the at least one reversing duct is a split duct.

* * * * *